US006698588B2

(12) United States Patent
Cheng

(10) Patent No.: US 6,698,588 B2
(45) Date of Patent: Mar. 2, 2004

(54) GOLF BAG DEVICE FOR HOLDING GOLF CLUBS

(76) Inventor: Wen-Chien Cheng, 4F, No. 8, Lane 153, Sec. 2 Chung-Hsing Rd., Ta-Li City Taichung Hsien (TW)

( * ) Notice: Subject to any disclaimer, the term of this patent is extended or adjusted under 35 U.S.C. 154(b) by 0 days.

(21) Appl. No.: 09/904,120

(22) Filed: Jul. 13, 2001

(65) Prior Publication Data

US 2003/0010658 A1 Jan. 16, 2003

(51) Int. Cl.[7] ..... A63B 55/04
(52) U.S. Cl. ..... 206/315.6; 206/315.7
(58) Field of Search ..... 206/315.2, 315.3, 206/315.6, 315.7

(56) References Cited

U.S. PATENT DOCUMENTS 1,833,534 A * 11/1931 Remfrey ..... 206/315.6
4,596,328 A * 6/1986 Solheim ..... 206/315.6
4,844,253 A * 7/1989 Reimers ..... 206/315.6
4,955,472 A * 9/1990 Yamazoe ..... 206/315.6
5,148,915 A * 9/1992 Ryan ..... 206/315.6
5,636,734 A * 6/1997 Smith ..... 206/315.6 X
5,971,147 A * 10/1999 Sutter ..... 206/315.6
6,109,433 A * 8/2000 Pratt ..... 206/315.6

* cited by examiner

*Primary Examiner*—Tri M. Mai
(74) *Attorney, Agent, or Firm*—Harrison & Egbert

(57) ABSTRACT

An improved golf bag device for fixing golf sticks includes a plurality of soft cushions, which are formed toward the handle corresponding to the bag opening, obliquity partition, and horizontal partition. The appearance edge of each soft cushion is provided with a plurality of vertical fixed troughs, which are arranged in order at a proper distance. Furthermore, the back edge of each soft cushion takes the advantage of a plurality of adhesive tapes which are divided into a male tape and a female tape corresponding to the edge thereon of the bag opening, obliquity partition, and horizontal partition.

1 Claim, 5 Drawing Sheets

GOLF BAG DEVICE FOR HOLDING GOLF CLUBS

BACKGROUND OF THE INVENTION

1. Field of the Invention

The present invention relates generally to a golf bag, and more particularly to an improved golf bag device for holding golf clubs.

2. Description of Related Art

The conventional golf bag 1 is provided with a simple partition 3 and formed plurality of sections 4 for putting the golf clubs 2 in place (as shown in FIG. 1). However, the golf clubs 2 are not fixed in place when the golf bag 1 is carried that causes said golf clubs 2 to slide and swing easily. As a result of the sliding and swinging the rod bodies of golf clubs 2 are hitting to each other. Besides, the golf clubs 2 are intersecting in the golf bag 1 which affects the desired appearance of the golfer.

BRIEF SUMMARY OF THE INVENTION

The primary objective of the present invention is therefore to provide an improved golf bag device for fixing golf stick. The main feature of the present invention is provided with a plurality of vertical fixed troughs of soft cushion which are arranged in order at a proper distance. The back edge of each soft cushion takes the advantage of a plurality of adhesive tapes corresponding to the bag opening, obliquity partition, and horizontal partition.

Therefore, the present invention enables the golf stick to be convenient to insert and fix into the fixed trough of soft cushion or to pull out quickly from the fixed trough, and further provides an aesthetically pleasing appearance with respect to the arranging in order of the golf sticks in place and preventing the golf sticks from intersection, scrapes or contacts.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
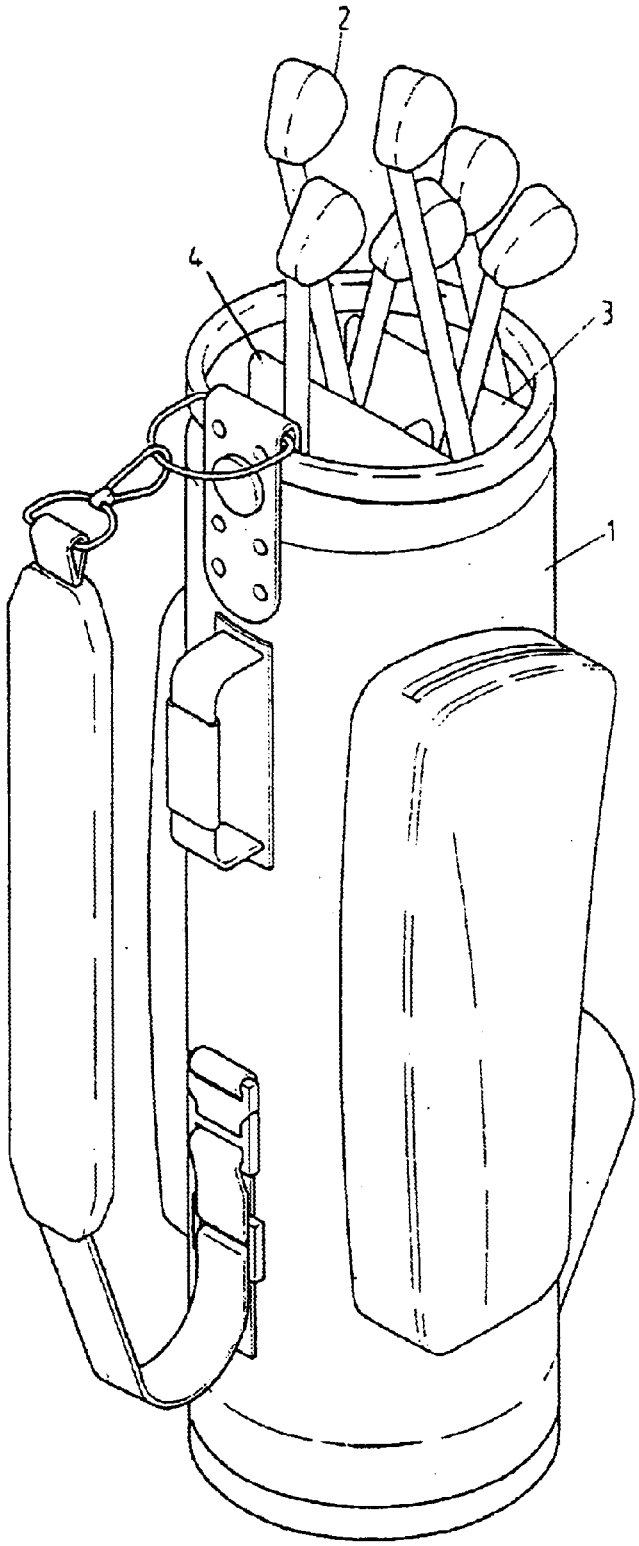
FIG. 1 shows a partial perspective view of the prior art golf bag in fixing the golf stick.
Figure 2:
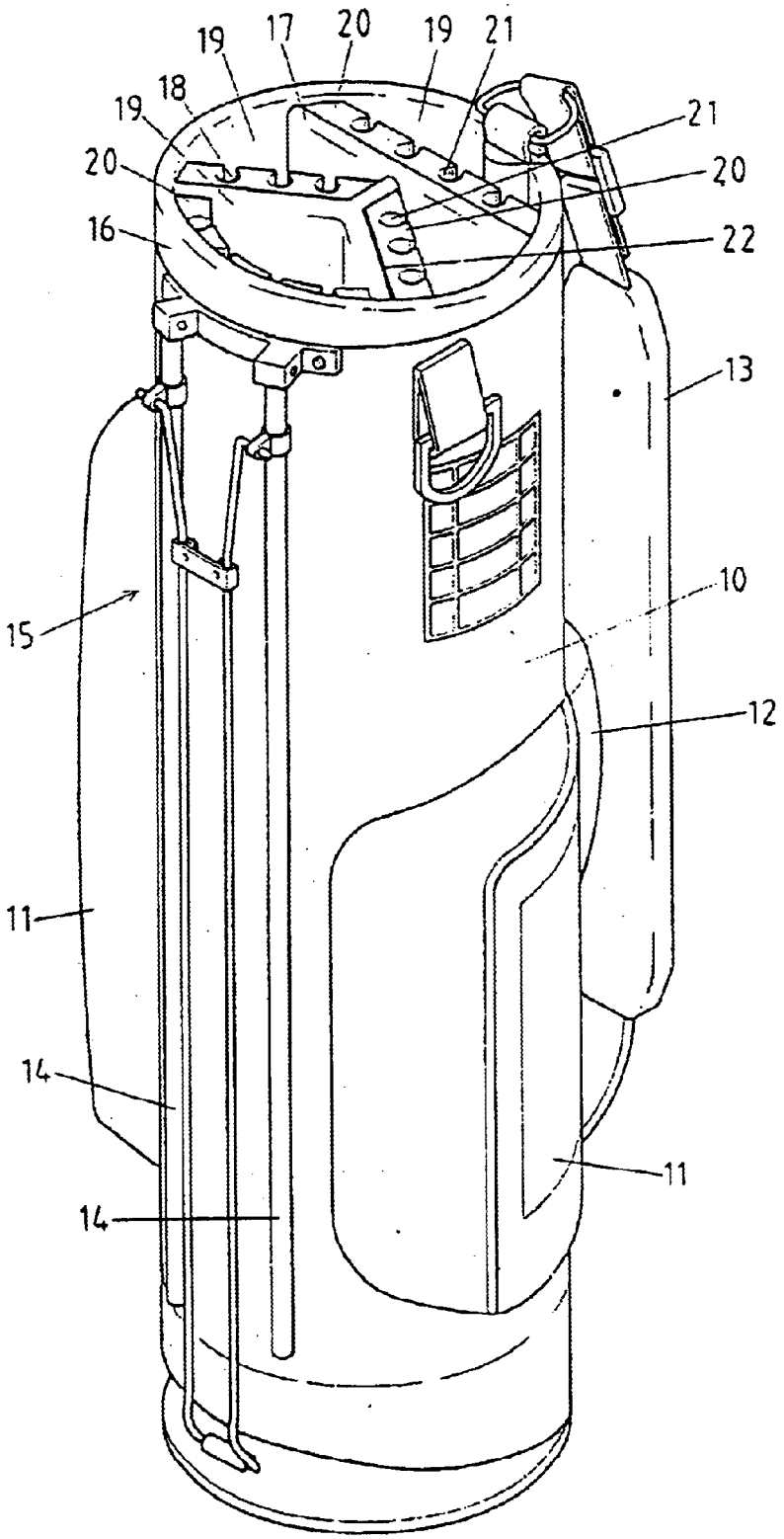
FIG. 2 shows a perspective view of the present invention.
Figure 3:
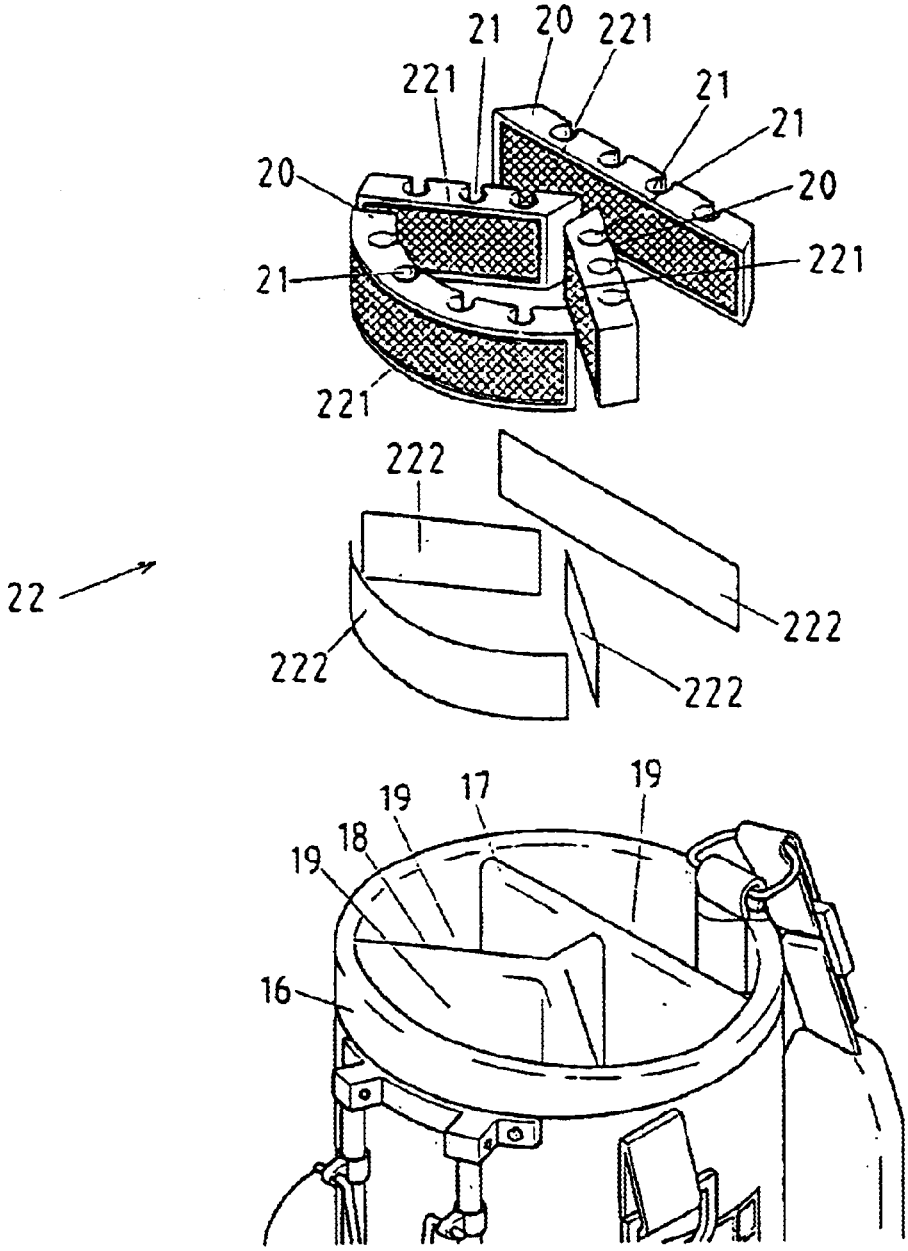
FIG. 3 shows an exploded view of the present invention.

As shown in FIGS. 2 and 3, the present invention improved golf bag device for holding golf clubs, being comprised of a bag 10, a plurality of soft cushions 20, and a plurality of adhesive tapes 22.

The bag 10 is provided with each protuberance collection bag 11 sewing at both sides, with a handle 12 provided between the collection bag 11, and further with a shoulder belt 13 that can be adjusted to long or to short. In addition, at the front edge of bag 10 is fixed with support rod 14 of unfolding device 15, and the upper section bag opening 16 is provided with horizontal partition 17 and obliquity partition 18, which formed a plurality of sections 19 in the inner bag 10.

The plurality of soft cushions 20 are formed toward the handle 12 corresponding to the bag opening 16, obliquity partition 18, and horizontal partition 17. The appearance edge of each soft cushion 20 is provided with a plurality of vertical fixed troughs 21 which are arranged in order at a proper distance. Furthermore, the back edge of each soft cushion 20 takes the advantage of a plurality of adhesive tapes 22 corresponding to the bag opening 16, obliquity partition 18, and horizontal partition 17.

The plurality of adhesive tapes 22 are divided into a male tape 221 and a female tape 222 which can be repeatedly used. The male tape 221 and female tape 222 correspond to the back side of soft cushion 20, and face the edge thereon of the bag opening 16, obliquity partition 18, and horizontal partition 17.

Figure 4:
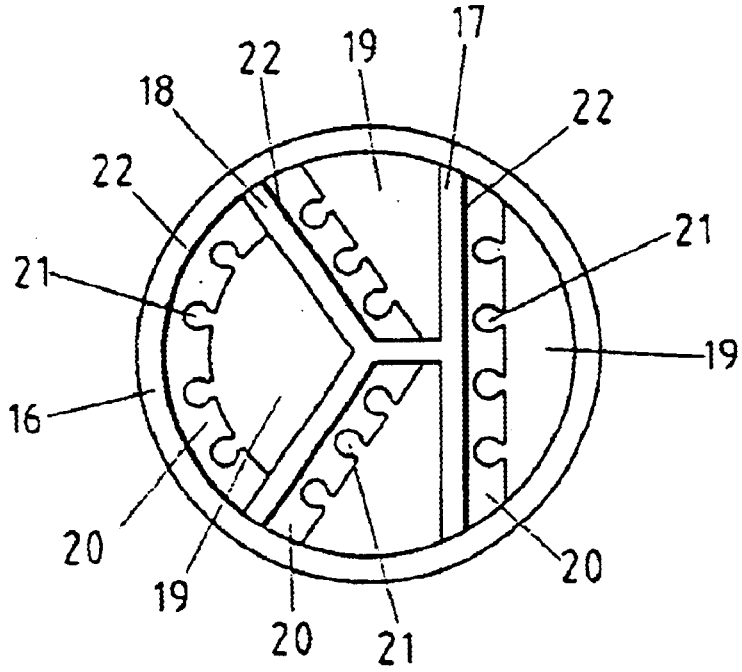
FIG. 4 shows an upper view of the present invention.
Figure 5:
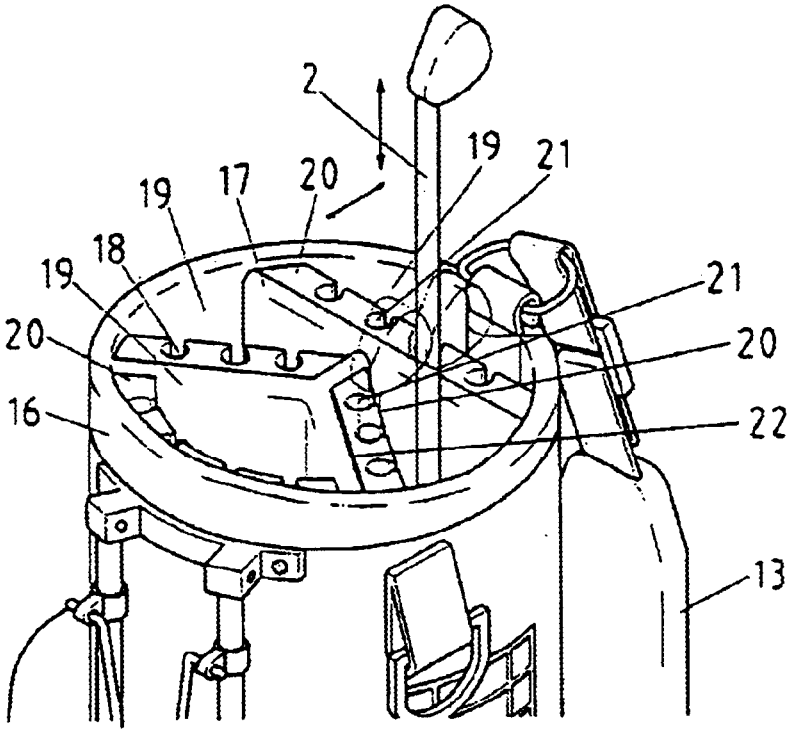
FIG. 5 shows a schematic view of the present invention in use.

As the component described above, the improved golf bag device enables the golf stick 2 to be convenient to insert and fix into the fixed trough 21 of soft cushion 20, or to pull out quickly from the fixed trough 21 (as shown in FIGS. 4 and 5). Therefore, the present invention achieves an aesthetically pleasing appearance with respect to the arranging in order of the golf sticks 2 in place and preventing said golf sticks 2 from intersection, scrapes or contacts.

The following is the description of the present invention in operation to achieve its effect:

The present invention takes the advantage of soft cushion 20 of a plurality of vertical fixed troughs 21 which are arranged in order at a proper distance, so as to form soft cushions 20 toward the handle 12 corresponding separately to the bag opening 16, obliquity partition 18, and horizontal partition 17. In addition, the back edge of each soft cushion 20 takes the advantage of a plurality of adhesive tapes 22 corresponding to the bag opening 16, obliquity partition 18, and horizontal partition 17. With this special design of improved golf bag device providing the golf stick 2 is convenient to insert or to pull from the section 19 of bag 10 in which said golf stick 2 is inserted and fixed into the fixed trough 21 of soft cushion 20, or is pulled out horizontally from the fixed trough 21. All of the golf sticks 2 are arranged parallel and are prevented from intersection, scrapes or contacts.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claim.

I claim:

1. A golf bag apparatus comprising:

a bag member having a first collection bag affixed by sewing at one side thereof, said bag member having a second collection bag affixed by sewing to an opposite side thereof, said bag member having a handle affixed thereto in a location between said first and second collection bags, said bag member having a shoulder belt extending therefrom, said shoulder belt having an adjustable length, said bag member having a support rod affixed to a surface thereof, said bag member having an interior with an opening thereto forced at an upper end of said bag members; said opening having a first partition extending vertically within said bag member and extending across said opening, said opening having a second partition of an oblique shape extending downwardly vertically into said bag member, said first and second partitions defining a plurality of golf club receiving sections on said interior of said bag member, each of said first and second partitions having a first side and a second side;

a plurality of soft cushions each having an outer surface with a plurality of vertical troughs formed in a spaced relation to each other so as to open to said outer surface, each of said plurality of soft cushions having an inner surface opposite said outlet surface; and a plurality of adhesive tapes affixed respectively to the inner surface of said plurality of soft cushions, a first adhesive tape of said plurality of adhesive tapes affixing a first soft cushion of said plurality of soft cushions only second adhesive tape of said plurality of adhesive tapes affixing a second soft cushion of said plurality of soft cushions to said first side of said second partition, a third adhesive tape of said plurality of adhesive tapes affixing a third soft cushion of said plurality of soft cushions to a surface of said interior of said bag member adjacent said opening.

* * * * *